United States Patent [19]

Hodak

[11] Patent Number: 4,913,810

[45] Date of Patent: Apr. 3, 1990

[54] SKIMMER APPARATUS SEALING AND CLOSURE ASSEMBLY

[76] Inventor: Jerry Hodak, 100 Hazel St., Zelienople, Pa. 16063

[21] Appl. No.: 311,814

[22] Filed: Feb. 17, 1989

[51] Int. Cl.[4] ..... E04H 3/20

[52] U.S. Cl. ..... 210/169; 210/416.2; 4/496; 4/498; 4/512

[58] Field of Search ..... 210/169, 242.1, 416.2; 4/496, 498, 507, 204, 512, 206; 220/378

[56] References Cited

U.S. PATENT DOCUMENTS

| | | | |
|---|---|---|---|
| 2,210,183 | 8/1940 | Schweighart | 220/378 |
| 2,504,072 | 4/1950 | Friend et al. | 220/378 |
| 2,700,186 | 1/1955 | Stover | 220/378 |
| 3,508,661 | 4/1970 | Diemond et al. | 210/169 |
| 4,281,422 | 8/1981 | Simonelli | 4/496 |
| 4,561,134 | 12/1985 | Mathews et al. | 4/498 |
| 4,735,714 | 4/1988 | Schall | 210/169 |
| 4,752,979 | 6/1988 | Goacher, Sr. | 4/496 |

*Primary Examiner*—W. Gary Jones
*Assistant Examiner*—Coreen Y. Lee
*Attorney, Agent, or Firm*—George C. Atwell

[57] ABSTRACT

Skimmer apparatus, for a recreational pool of the type where a housing of the skimmer is mounted outside the pool and has a port opening in sealed relation to a pool sidewall opening, is provided with an assembly, including a special gasket frame and a face plate, for fastening the housing to the pool sidewall for normal use, and further including a cover panel adapted to sealably mount over the face plate by gripping sealing engagement with a peripheral flange of the gasket frame to effectively close off the chamber of the skimmer housing for non-use or storage disposition.

7 Claims, 2 Drawing Sheets

SKIMMER APPARATUS SEALING AND CLOSURE ASSEMBLY

BACKGROUND OF THE INVENTION

This invention relates generally to apparatus for surface skimming the water in a recreational pool and more particularly pertains to means for sealing a skimmer apparatus in its mounted operative position which cooperates with additional means for closing off the skimmer for insitu storage.

BRIEF DESCRIPTION OF THE PRIOR ART

In recreational pools, including typical swimming pool structures and more specialized spa and whirlpool structures, etc., it is common to utilize pool cleaning apparatus which employs a skimming principle. Typically, such apparatus includes a housing mounted outside the pool wall with a substantially large port opening in sealed registration with an opening in the pool wall at the water surface level. Such apparatus is provided with a means for creating a partial vacuum within the chamber of the housing whereby surface water continuously flowing from the pool surface and into the chamber moves through exterior filtering equipment and thence back into the pool by means of a relatively smaller port entry at a lower level in the pool wall.

The means of mounting the port opening of the skimmer housing to the pool wall typically includes a rigid face plate, generally rectilinear in configuration, defining a large central opening and a series of fastener apertures in a symmetrical pattern adjacent its edge to enable it to be joinably sealed, usually in conjunction with one or more gaskets, against the inside surface of the pool wall. The fasteners extend through the face plate apertures and aligned complimentary apertures in the pool wall and threadably fasten into appropriate sockets disposed in a lip around the port opening of the housing.

When a recreational pool utilizing a skimmer apparatus of the type generally heretofore described is taken out of use, it is desirable to maintain the skimmer apparatus in its installed position, however, no specific provision is made for closing off the waterflow channel into the housing chamber when the operation of the apparatus is curtailed for a substantial length of time.

SUMMARY OF THE INVENTION

The present invention comprehends the provision of recreational pool skimmer apparatus, including a housing defining an intake chamber having a substantially large port opening mountable outside the pool in sealed registration with a sidewall opening, means for creating a partial vacuum in the chamber whereby surface water from the pool is atmospherically pushed from the chamber and through a filtering unit in a continuous flow, and, in combination therewith, a sealing and closure assembly for sealably securing the port opening of the housing in its registration with the sidewall opening, including a gasket frame, a face plate and a cover panel.

The gasket frame has a planar central body portion with first and second oppositely-disposed flat surfaces and a central opening closely similar in size and shape to the port opening of the housing. The gasket frame's first flat surface bears compressibly against the inside surface wall of the pool. An integral edge flange projects peripherally from the body portion of the gasket frame, in a direction away from the chamber and substantially normal to the second flat surface of the body portion, and is designed to fit within a similar flange integral to the cover panel hereafter described.

The cover panel has a major substantially thin-walled body portion and an integral peripheral projecting edge flange which is adapted to be slidably and sealably engaged, in removable overlapping relation, on the gasket frame flange and thereby form a substantially shallow pocket area in which is contained the face plate member of the sealing and closure assembly.

The face plate is a planar member with a central opening similar in shape but slightly smaller than the port opening to the chamber, and this central opening in the face plate is further defined by flange means integral to the face plate and projecting at least partially into the central opening in the gasket frame.

The face plate and the gasket frame have complimentary fastening apertures to enable them to be fastened as a unit to the area of the housing defining the port opening, with the pool sidewall compressibly secured between the face edge of the housing and the back or first side of the gasket frame.

The cover panel is only used when it is desired to take the pool out of service anc close off the entrance from the pool to the housing chamber, to thereby form an airtight seal over the chamber entrance, closing it off entirely from the interior of the pool and the atmosphere.

It is a primary objective of the present invention to provide skimmer apparatus for a recreational pool having specially designed gasket means for sealing a face plate to the skimmer housing in registration with an opening in the pool sidewall, wherein the gasket means also has provision for forming a removable seal in cooperation with a cover panel, and enclosing the face plate during a period when the pool is out of use.

Further objectives, features, and characteristics of the present invention will be understood from the ensuing detailed description of the preferred embodiment of the invention.

DETAILED DESCRIPTION OF THE PREFERRED EMBODIMENTS

Figure 1:
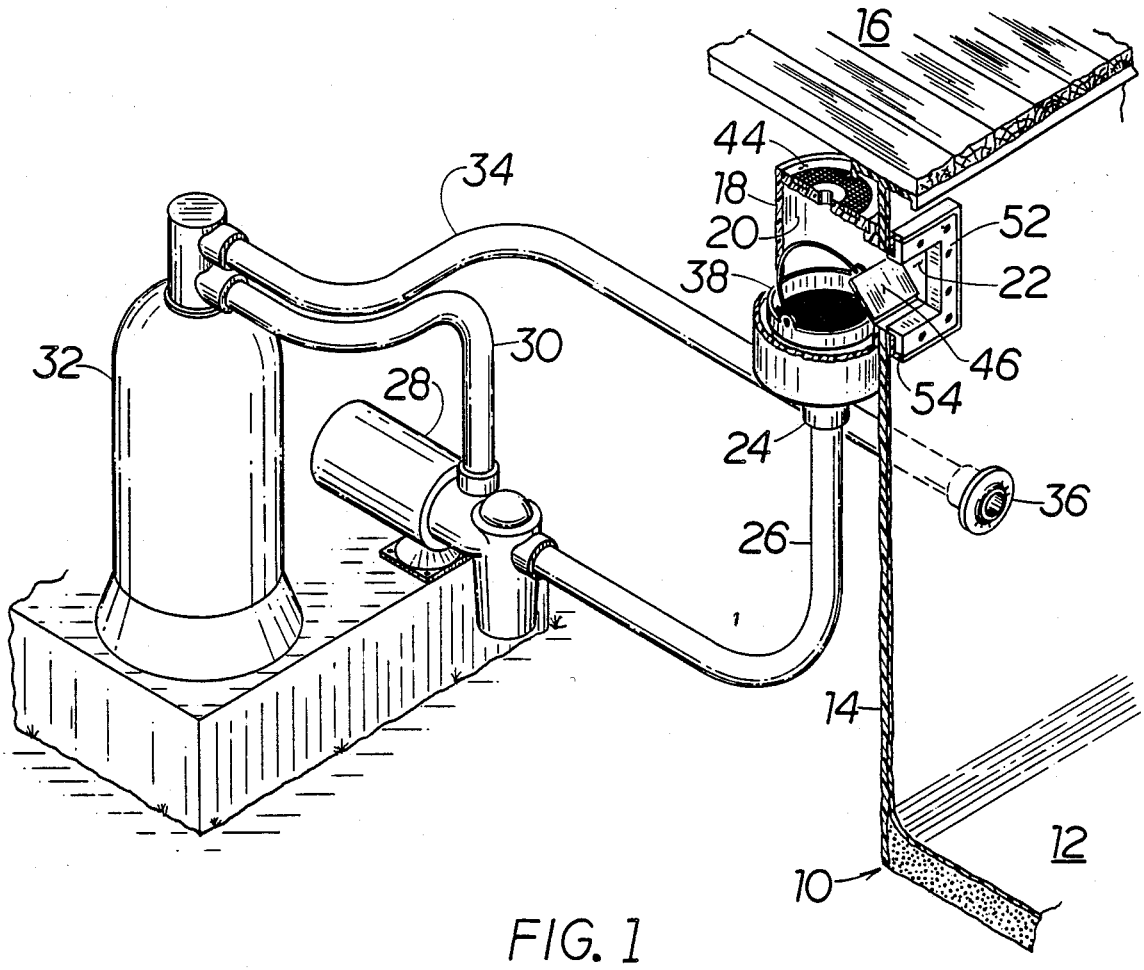
FIG. 1 is a perspective view of skimmer apparatus in its mounted operative position relative to a recreational pool, in accordance with the presently preferred embodiment of the invention.

FIG. 1 illustrates a swimming pool structure 10 having a floor 12 and a sidewall 14 and an upper deck surface 16. Disposed outward from the pool structure is skimmer apparatus including a housing 18 defining an interior chamber 20 having a port opening 22 disposed at the preferred surface level of water within the pool 10. The housing 18 has a downwardly funneling lower end portion 24 in flow communication with a conduit 26 which leads to the intake side of a pump mechanism 28. From the output side of the pump mechanism 28, a conduit 30 leads to a filtering unit 32, and a return conduit 34 connects the filtering unit 32 back to the pool 10 at an inlet port 36.

The skimmer apparatus housing 18, as shown in FIG. 1, has a generally cylindrical configuration, a portion of which is cut away to reveal certain internal components within the chamber 20.

Within the chamber 20 is a removable filter basket 38 having a bale handle 40 to enable its removal either directly upwardly from the chamber by coincidental removal of a lid 44 or outwardly through the port 22. The chamber 20 also contains a pivotally-mounted member 46 which normally serves to block passage of relatively large objects carried on the pool surface which are nevertheless small enough to move inwardly through the port opening 22. The member 46 may be pivoted to extend outwardly through the port opening 22 to enable withdrawal of the basket 38 through the port opening where it is inconvenient to remove the lid 44 from the housing 18, as, for example, when the housing 18 is mounted substantially close to an overhead obstruction as shown in FIG. 1.

Figure 3:
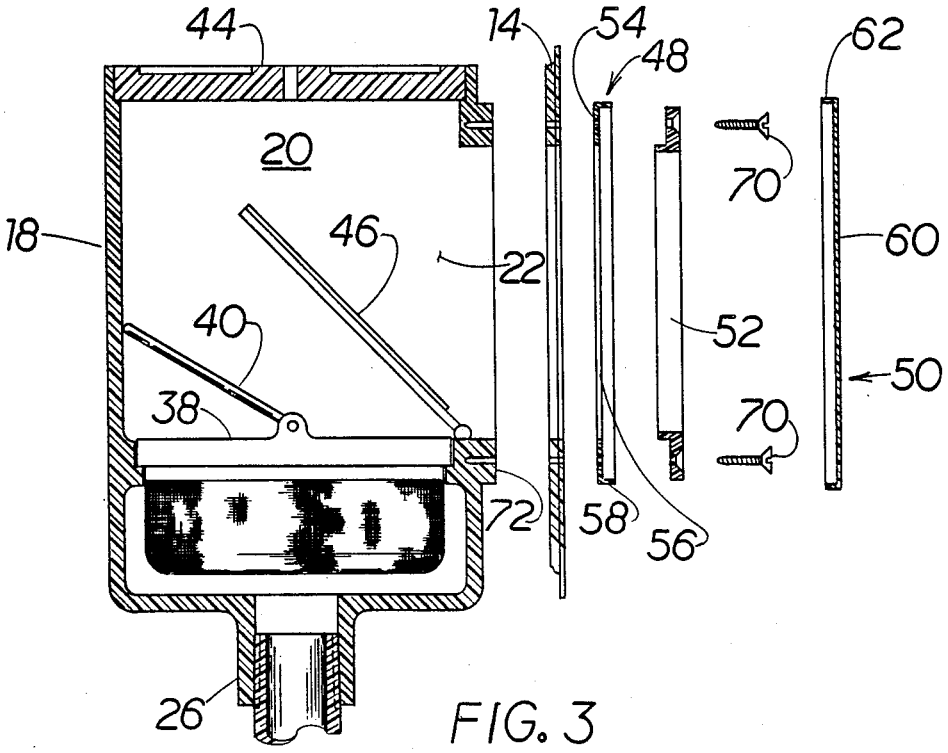
FIG. 3 is a side elevational view of certain components of the present invention illustrated in vertical section.
Figure 2:
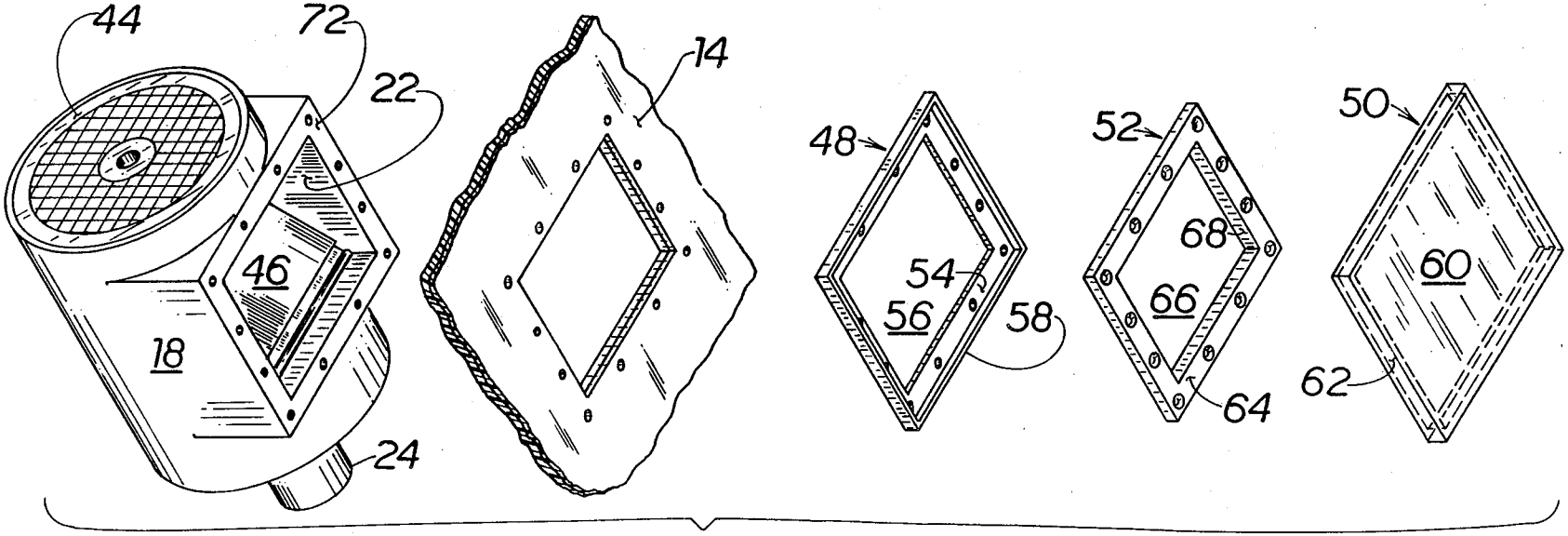
FIG. 2 is a perspective "exploded" view of certain components of the preferred embodiment of the invention first shown in FIG. 1.

The skimmer apparatus of the present invention includes a sealing and closing assembly as best shown in FIGS. 2 and 3, including a gasket frame 48, a cover panel 50, and a face plate 52 (FIGS. 2 and 3).

The gasket frame 48 has a planar central body portion 54 defining a substantially large central opening 56. A first flat surface of the body portion 54 is disposed toward the pool wall and an oppositely-disposed second flat surface faces outwardly toward the face plate 52 as shown in FIG. 3. The entire peripheral edge of the gasket frame 48 is an integral flange 58 which projects at an angle generally normal to the planar body portion 54.

The configuration of the cover panel 50 is substantially similar to that of the gasket frame 48 except that its thin-walled body portion 60 has no corresponding central opening. The cover panel 50 has a peripheral edge flange 62 at an angle generally normal to the body portion 60.

The face plate 52 has a relatively thick rigid central body portion 64 defining a central opening 66 of a sixe slightly smaller than the opening 56 in the gasket frame 48. The opening 56 is specifically defined by a flange 68 which, in FIGS. 2 and 3, projects toward the gasket frame 48.

The installation of the housing 18 to the pool wall 14 is accomplished by utilization of a plurality of fasteners in the form of threaded screws 70 which are inserted through a complimentary plurality of apertures in the face plate 52. The gasket frame 48 and the pool wall 14 are provided with properly aligned complimentary apertures to accommodate the fasteners 70 which threadably engage into accommodating sockets provided about a lip 72 on the housing 18 which defines the port opening 22.

The gasket frame 54 is preferably formed from a non-corrosive semi-rigid material, such as a thermoplastic, having some limited flexibility and compressibility, whereby it serves as a seal between the face plate 52 and the pool wall 14. Although not shown, an additional sealing gasket, familiar in the prior art, may be provided exterior the pool wall 14 to assure a tight seal of the lip 72 against the outside surface of the pool wall 14.

In its disposition for normal use of the pool 10, the skimmer apparatus appears as shown in FIG. 1, with the face plate 52 having its outer edge overlapped by the flange 54 of the gasket frame 48. The cover plate 50 is not shown in FIG. 1. It is only utilized when it is intended to discontinue operation of the skimmer apparatus as, for example, when the pool may be taken out of use for the winter months or for any other reason. Then the cover plate 50 is manually snapped into position across the face plate 52 whereby the flange 62 slides over and engages against the outer surface of the flange 58 of the gasket frame 48. The cover plate 50 is preferably formed from the same material as the gasket frame 48 whereby its flange 62 will flexibly conform and tightly compress against the outer surface of the flange 58.

With regard to the face plate 52, it should be noted that its inwardly-directed flange 68 serves as a continuous ledge defining the opening 66 on which the gasket frame 48 is installably carried, and that the extreme outer edge of this ledge, when the face plate is in its installed position, projects slightly into the port opening 22 and past the inside corner of the lip 72 facilitate sealing compression of the gasket member 48 and the pool wall 14 between the face plate 52 and the lip 72.

Figure 4:
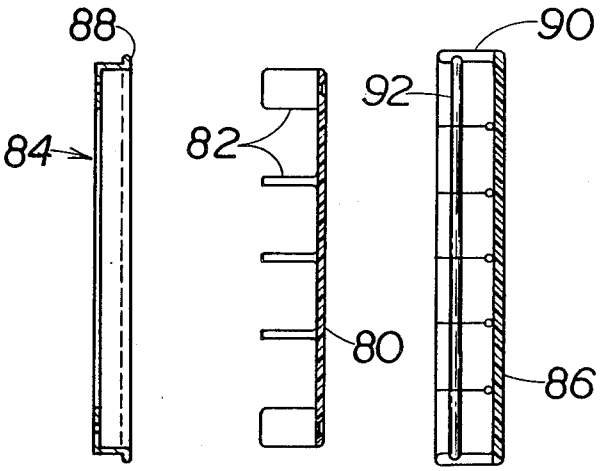
FIG. 4 is a side elevational view illustrating components of a second or alternative embodiment of the present invention.

FIG. 4 illustrates an alternate embodiment of the sealing and closure assembly of the present invention which is adaptable to accomplishing a sealed closure where the face plate is of a special construction such as that disclosed in U.S. Pat. No. 4,735,714. In that patent, a ribbed face plate, such as face plate 80, is provided to prevent inadvertent full closure of the port opening during use of the pool. The plurality of integral projecting ribs 82 on face plate 80 create interstices therebetween that will permit water and air passage in the event the hip or other part of the body of a swimmer accidentally seals off the face of the skimmer. This rib face plate provides a worthwhile functional feature but also requires, for a sealing and closure assembly of the type heretofore described, that a gasket frame 84 of modified structure be provided in combination with a cover panel 86 which is modified in its form as compared to the cover panel 50 of the aforedescribed preferred embodiment.

More specifically, the gasket frame 84 shown in FIG. 4 has integral outer edge lip portions 88, semi-arcuate in cross-section and offset from the major body portion of the frame. The cover panel 86 has an integral flange 90 of sufficient extension or width to reach past the breadth of the face plate 80. Inwardly adjacent the outer edge of the flange 90 is continuous recess 92 adapted tyo snap onto the lip portions 88 and fully aboug the frame 84 whereby the face plate 80 becomes fully enclosed when the cover panel 86 is in the installed position as heretofore described.

The foregoing description discloses and describes several exemplary embodiments of the present invention. Those skilled in the art will understand that other variations and modifications may be possible and practical and may come within the scope of the appended claims.

I claim:

1. Skimmer apparatus for a recreational pool comprising: a skimmer chamber having a substantially large port opening mountable outside the pool in sealed registration with a sidewall opening in the pool, whereby surface water from the pool flows through the port opening and into the chamber, and means for draining the water from the chamber;

a sealing and closure assembly for sealably securing the port opening in its registration with the sidewall opening, including a gasket frame, a face plate, and a cover panel;

the gasket frame having a planar central body portion with first and second oppositely-disposed flat surfaces and a central opening closely similar in size and shape to the port opening, the first flat surface bearing compressively against the inside surface wall of the pool, and an integral edge flange projecting peripherally from the body portion in a direction away from the chamber and substantially normal to the second flat surface of the body portion;

the cover panel having a major substantially thin-walled body portion and an integral peripheral projecting edge flange adapted to be slidably and sealably engaged in removable overlapping relation with the gasket frame flange and thereby form a pocket area for containing the face plate between the second surface of the gasket frame and the major body portion of the cover panel; and the face plate having a planar body with a central opening similar in shape but slightly smaller than the port opening, and the central opening in the face plate being further defined by flange means integral to the face plate and projecting at least partially into the central opening in the gasket frame.

2. The skimmer apparatus of claim 1 further comprising a plurality of fastener apertures in the face plate and the gasket frame to enable the face plate and gasket frame to be mounted as a unit in fastened relationship t the housing in alignment with the port opening: and the pool sidewall, in the area definign the pool sidewall opening, compressed between the unit and the housing.

3. The skimmer apparatus of claim 1 wherein the thickness of the face plate is substantially identical to the depth of the pocket area.

4. The skimmer apparatus of claim 1 wherein the face plate is substantially rigid.

5. The skimmer apparatus of claim 4 wherein the gasket frame is formed of a semi-flexible and compressible material.

6. The skimmer apparatus of claim 1 wherein the face plate is rigid, the gasket frame and the panel cover are sufficiently rigid to normally retain their shape but are of sufficient flexibility and compressibility to enable their respective edge flanges to be slidably engaged in overlapping sealing relationship to form the pocket area containing the face plate and thereby completely curtail waterflow communication from the pool and into the chamber.

7. The skimmer apparatus of claim 1 wherein the face plate has a plurality of integral ribs of equal length projecting in the same direction and normal to the body of the face plate, and the edge flange of the cover panel extends a distance greater than the length of the projecting ribs.

* * * * *